US008791373B1

(12) United States Patent
Hull et al.

(10) Patent No.: US 8,791,373 B1
(45) Date of Patent: Jul. 29, 2014

(54) METHOD AND APPARATUS FOR PROVIDING AN ELECTROMAGNETIC PULSE SHIELD GROUND PATH

(71) Applicant: The Boeing Company, Chicago, IL (US)

(72) Inventors: Mahlon Bruce Hull, Everett, WA (US); Pete Pereira, Marysville, WA (US)

(73) Assignee: The Boeing Company, Chicago, IL (US)

( * ) Notice: Subject to any disclaimer, the term of this patent is extended or adjusted under 35 U.S.C. 154(b) by 0 days.

(21) Appl. No.: 13/737,457

(22) Filed: Jan. 9, 2013

(51) Int. Cl.
*H01R 13/648* (2006.01)

(52) U.S. Cl.
USPC ..... 174/359; 174/360; 174/376; 174/51; 439/98

(58) Field of Classification Search
USPC ..... 174/51, 376, 359, 360; 439/98
See application file for complete search history.

(56) References Cited

U.S. PATENT DOCUMENTS

| | | | | | |
|---|---|---|---|---|---|
| 4,816,967 | A * | 3/1989 | Landis | 361/762 |
| 5,122,068 | A * | 6/1992 | Koss | 439/98 |
| 5,493,068 | A * | 2/1996 | Klein et al. | 174/362 |
| 5,823,804 | A * | 10/1998 | Auclair | 439/98 |
| 6,075,299 | A * | 6/2000 | Miyazaki et al. | 310/75 R |
| 6,160,217 | A * | 12/2000 | Auclair | 174/51 |
| 6,252,166 | B1 * | 6/2001 | Leschinger | 174/51 |
| RE37,724 | E * | 6/2002 | Robinson | 174/78 |
| 7,431,593 | B2 * | 10/2008 | Hunter et al. | 439/98 |
| 7,595,455 | B2 * | 9/2009 | Robinson | 174/655 |
| 2011/0240328 | A1 * | 10/2011 | Kiely | 174/51 |

OTHER PUBLICATIONS

"Electromagnetic Pulse (EMP) and Tempest Protection for Facilities;" Chapter 5 Facility Design; dated Dec. 31, 1990.
Photograph "Torque Terminal Nuts to 12-14 TTT-LB" received Dec. 5, 2012.

* cited by examiner

*Primary Examiner* — Hung Ngo
(74) *Attorney, Agent, or Firm* — Alston & Bird LLP

(57) ABSTRACT

A method and apparatus are disclosed in order to provide an electromagnetic pulse shield ground path. In this regard, a shielded power feeder assembly is provided that includes a plurality of conductors comprising a neutral conductor and at least one power feeder conductor. Each conductor includes an electromagnetic pulse shield. The shielded power feeder assembly also includes a fanning bar ground block. The fanning bar ground block includes a body member defining a plurality of openings for receiving respective neutral and power feeder conductors. The fanning bar ground block also includes a plurality of barrels associated with respective openings defined by the body member and configured to be positioned in electrical contact with the shield of the conductor extending through the respective opening. The shielded power feeder assembly also includes a ground path extending from the fanning bar ground block. A corresponding method is also disclosed.

20 Claims, 4 Drawing Sheets

METHOD AND APPARATUS FOR PROVIDING AN ELECTROMAGNETIC PULSE SHIELD GROUND PATH

TECHNOLOGICAL FIELD

An example embodiment of the present disclosure relates generally to shielded power feeders and, more particularly, to a method and apparatus for providing a ground path for the electromagnetic pulse shields of the power feeders.

BACKGROUND

Power that is generated at a location remote from the load may be transmitted from the source of the power generation to the load via one or more power feeders. For example, an engine nacelle of an aircraft may include an integrated drive generator that may generate power that is to be distributed to one or more loads within the body of the aircraft. Thus, a plurality of power feeders, such as power feeders for each of the three phases of the generated power and a neutral power feeder, may extend from the integrated drive generator into the body of the aircraft, such as via a wing pylori.

Electromagnetic pulses may sometimes propagate through space. In instances such as those described above in which the power feeders extend outside of the body of an aircraft, the power feeders may be exposed to the electromagnetic pulses. To avoid the deleterious effect of the electromagnetic pulses upon the power feeders, the power feeders may be shielded, such as with respective electromagnetic pulse shields. The electromagnetic pulse shields are then grounded. Various techniques have been developed for grounding the electromagnetic pulse shields. For example, a conductive pigtail may be connected to each electromagnetic pulse shield. The pigtails may then be connected to one another, such as by being daisy chained together. The daisy chained pigtails may then be connected to ground, such as defined by the engine frame. However, the use of pigtails may be production intensive, thereby increasing the labor and time required during manufacture.

The power feeders may alternatively be protected from electromagnetic pulses in other manners. For example, a faraday cage may house the power feeders and protect the power feeders from electromagnetic pulses. However, a faraday cage will increase the overall weight, which may be disadvantageous in an instance in which the faraday cage is carried by a vehicle, such as an aircraft. Additionally, in the foregoing example in which the power feeders extend from an integrated drive generator, the faraday cage may be mounted to the integrated drive generator housing. As such, the integrated drive generator housing may also have to be redesigned to appropriately mate with the faraday housing.

BRIEF SUMMARY

A method and apparatus are provided in accordance with an example embodiment of the present disclosure in order to provide an electromagnetic pulse shield ground path. In this regard, the method and apparatus of one embodiment may permit the electromagnetic shields of a plurality of power feeders to be grounded in an efficient and uniform manner. In addition, the method and apparatus of one embodiment may permit the electromagnetic shields of a plurality of power feeders to be grounded in a manner that does not require modification of other components, such as an integrated drive generator housing.

In one embodiment, an apparatus is disclosed for providing an electromagnetic pulse shield ground path. The apparatus of this embodiment includes a fanning bar ground block. The fanning bar ground block includes a body member defining a plurality of openings for receiving respective conductors. The plurality of openings include a neutral opening and at least one power feeder opening. The neutral opening is configured to receive a shielded neutral conductor and each power feeder opening is configured to receive a respective shielded power feeder conductor. The fanning bar ground block further includes a plurality of barrels associated with respective openings defined by the body member and configured to be positioned in electrical contact with a shield of the conductor extending through the respective opening. The apparatus of this embodiment also includes a plurality of clamps. Each clamp is associated with a respective one of the conductors and is configured to secure the shield of the respective conductor to the barrel that is positioned in electrical contact with the shield. The apparatus further includes a ground path extending from the fanning bar ground block.

The body member of the fanning bar ground block may also include a housing formed of a conductive material and an insert disposed within the housing. In this embodiment, the insert is formed of an insulative material and defines the plurality of openings. Additionally, the plurality of barrels and the ground path may be in electrical contact with the housing. The plurality of barrels may extend outwardly from the housing. The plurality of barrels may be formed of a conductive material and may be aligned with respective openings defined by the body member. In one embodiment, the apparatus may also include a friction material carried by the plurality of barrels.

In another embodiment, a shielded power feeder assembly is provided that includes a plurality of conductors comprising a neutral conductor and at least one power feeder conductor. Each conductor includes an electromagnetic pulse shield. The shielded power feeder assembly of this embodiment also includes a fanning bar ground block. The fanning bar ground block includes a body member defining a plurality of openings for receiving respective neutral and power feeder conductors. The fanning bar ground block also includes a plurality of barrels associated with respective openings defined by the body member and configured to be positioned in electrical contact with the shield of the conductor extending through the respective opening. The shielded power feeder assembly of this embodiment also includes a ground path extending from the fanning bar ground block.

The plurality of conductors may be configured to extend from an integrated drive generator positioned outside of a body of a vehicle to an interior of the body of the vehicle. In this regard, the fanning bar ground block and the ground path may also be configured to be positioned outside of the body of the vehicle. The shielded power feeder assembly of one embodiment also includes a plurality of clamps. In this embodiment, each clamp may be associated with a respective one of the conductors and may be configured to secure the shield of the respective conductor to the barrel that is positioned in electrical contact with the shield.

The body member of the fanning bar ground block of one embodiment includes a housing formed of a conductive material and an insert disposed within the housing. The insert may be formed of an insulative material and may define the plurality of openings. In this embodiment, the plurality of barrels and the ground path are in electrical contact with the housing. The plurality of barrels may extend outwardly from the housing. In one embodiment, the plurality of barrels are formed of a conductive material and are aligned with respective openings defined by the body member. The shielded power feeder assembly of one embodiment may also include a friction material carried by the plurality of barrels.

In a further embodiment, a method is disclosed for providing an electromagnetic pulse shield ground path. The method includes extending a plurality of conductors through respective openings defined by a body member of a fanning bar ground block. The plurality of conductors include a neutral conductor and at least one power feeder conductor. Each conductor includes an electromagnetic pulse shield. The method also includes establishing electrical contact between a plurality of barrels of the fanning bar ground block that are associated with respective openings defined by the body member and the shields of the conductors extending through the respective openings. The method further includes grounding the shields of the conductors via a ground path extending from the fanning bar ground block.

The method of one embodiment may extend the plurality of conductors through respective openings by extending the plurality of conductors from an integrated drive generator positioned outside of a body of a vehicle to an interior of the body of the vehicle. In this regard, the method may extend the plurality of conductors from the integrated drive generator of an engine nacelle to the interior of an aircraft. As such, the method may also include positioning the fanning bar ground block and the ground path outside of the body of the vehicle.

The method may also include securing the shields of the respective conductors to the barrels that are positioned in electrical contact with respective shields. In one embodiment, the body member of the fanning bar ground block includes a housing formed of a conductive material and an insert disposed within the housing. The insert of this embodiment is formed of an insulative material and defines the plurality of openings. Additionally, the method of this embodiment includes establishing electrical contact between the housing and the plurality of barrels and the ground path. The plurality of barrels may be formed of a conductive material. The method of one embodiment may also include aligning the barrels with respective openings defined by the body member.

BRIEF DESCRIPTION OF THE DRAWINGS

Figure 1:
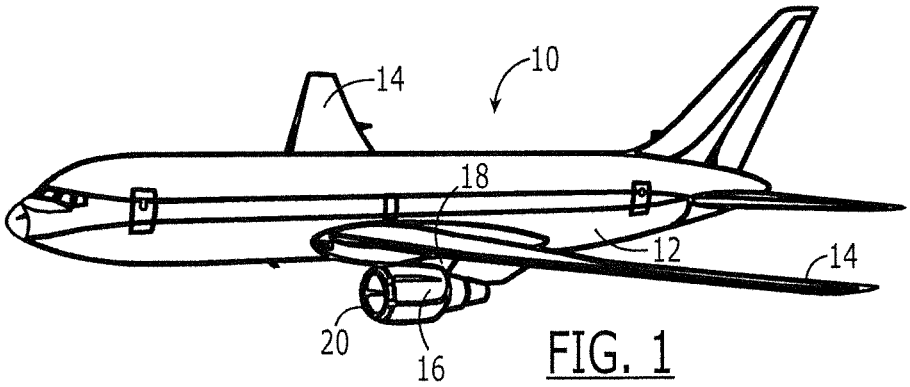
Figure 2:
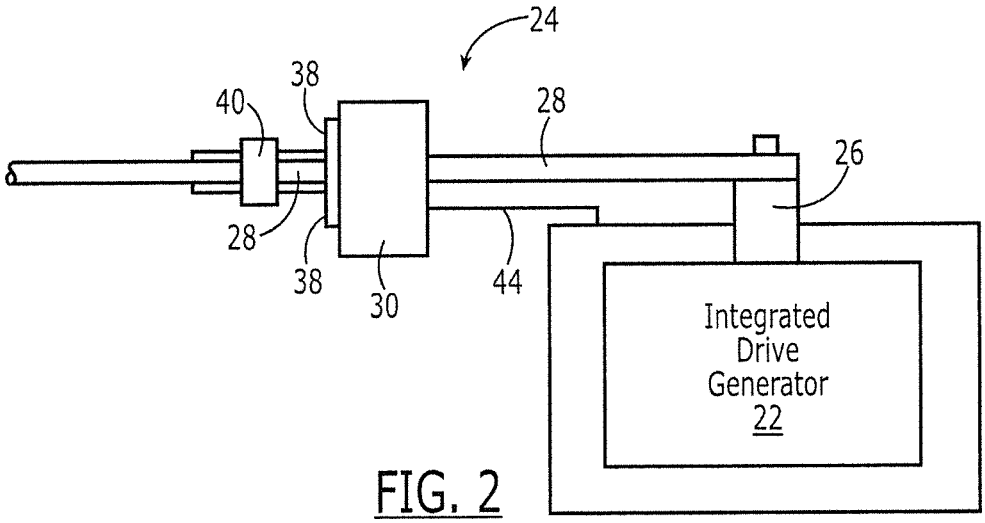
Figure 3:
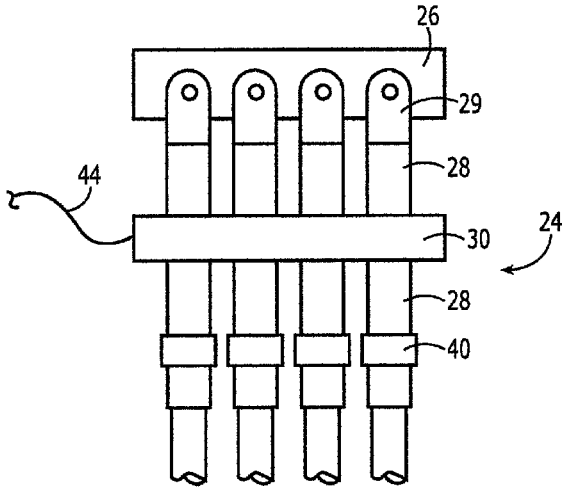
Figure 4:
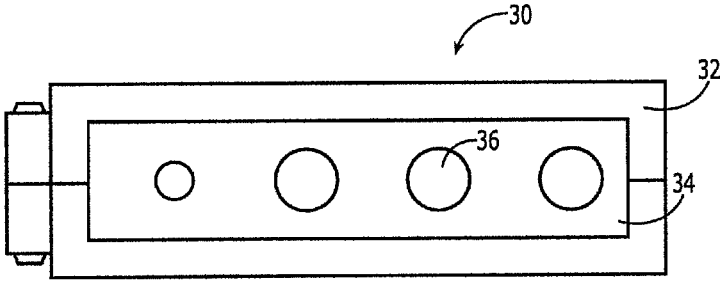
Figure 5:
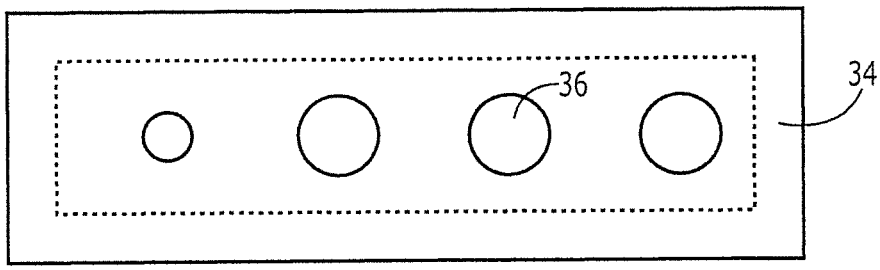
Figure 6:
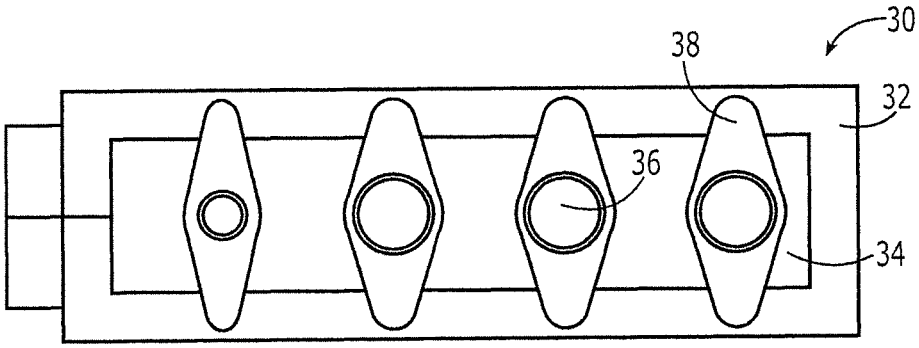
Figure 7:
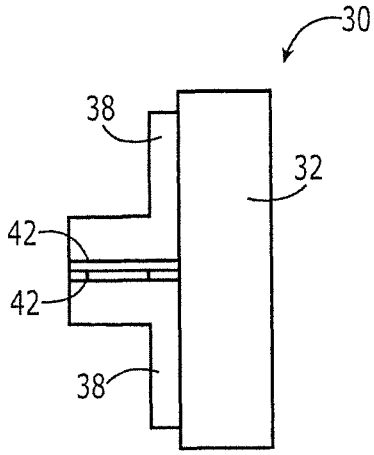
Figure 8:
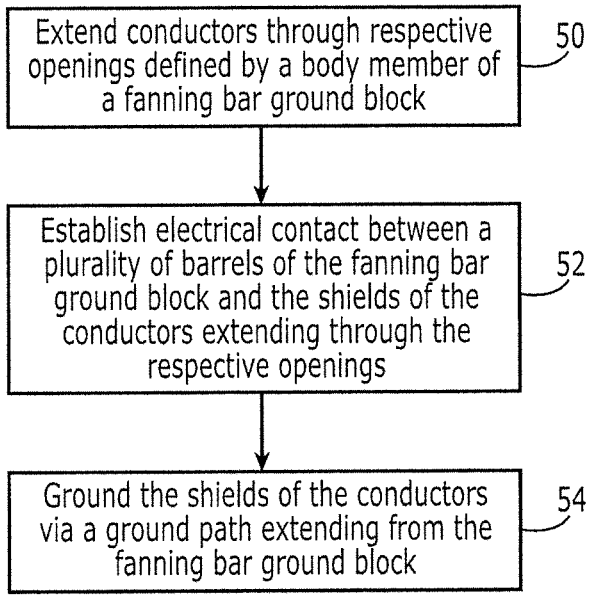
Figure 9:
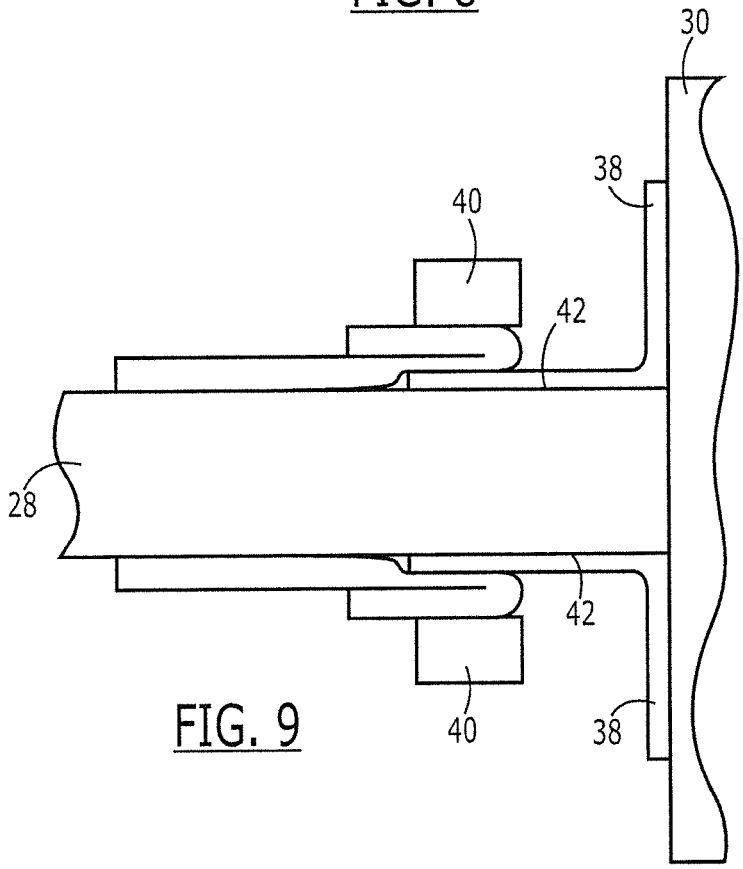

Having thus described certain example embodiments of the present disclosure in general terms, reference will hereinafter be made to the accompanying drawings, which are not necessarily drawn to scale, and wherein:

FIG. 1 is a perspective view of an aircraft that may include an integrated drive generator with an engine nacelle;

FIG. 2 is a schematic representation of a shielded power feeder assembly in accordance with an example embodiment of the present disclosure;

FIG. 3 a top view of the shielded power feeder assembly of FIG. 2 in accordance with an example embodiment of the present disclosure;

FIG. 4 is a plan view of one side of a fanning bar ground block in accordance with an example embodiment of the present disclosure;

FIG. 5 is a plan view of an insert of the fanning bar ground block in accordance with an example embodiment of the present disclosure;

FIG. 6 is a plan view of another side of a fanning bar ground block, opposite the side of the fanning bar ground block depicted in FIG. 4, in accordance with an example embodiment of the present disclosure;

FIG. 7 is a side view of the fanning bar ground block of FIGS. 4 and 6 in accordance with an example embodiment of the present disclosure;

FIG. 8 is a flowchart of the operations performed in accordance with an example embodiment of the present disclosure; and FIG. 9 is a cross-sectional view of the shielded power feeder assembly in accordance with an example embodiment of the present disclosure.

DETAILED DESCRIPTION

The present disclosure now will be described more fully hereinafter with reference to the accompanying drawings, in which some, but not all embodiments are shown. Indeed, this disclosure may be embodied in many different forms and should not be construed as limited to the embodiments set forth herein; rather, these embodiments are provided so that this disclosure will satisfy applicable legal requirements. Like numbers refer to like elements throughout.

A method and apparatus, such as a shielded power feeder assembly, are provided in accordance with an example embodiment of the present disclosure in order to provide an electromagnetic pulse shield ground path. The method and apparatus may be utilized in a wide variety of applications in which one or more power feeders that carry power from a power source to a load may be exposed an electromagnetic pulse. In one embodiment, however, the method and apparatus may be employed to provide an electromagnetic pulse shield ground path for power feeders that carry power from a power source positioned external to the body of a vehicle to a load within the body of the vehicle. In this embodiment, at least the portion of the power feeders that is external to the body of the vehicle may otherwise be at some risk to exposure to an electromagnetic pulse.

By way of example, the method and apparatus of one embodiment may be employed to provide an electromagnetic pulse shield ground path for power feeders that carry power from a power source positioned external to the body of an aircraft to a load within the body of the aircraft, such as a power bus that extends through the body of the aircraft. As shown in FIG. 1, an aircraft 10 may include a body 12 and a pair of wings 14 extending outwardly therefrom. In the illustrated embodiment, the aircraft 10 also includes a pair of engines 16 carried by respective wings 14. In this regard, the engines 16 may be connected to the respective wings 14 by one or more pylons 18.

The aircraft 10 may also include a source of power external to the body 12 of the aircraft. For example, the aircraft 10 may include an integrated drive generator. For example, the integrated drive generator may be disposed within the engine nacelle 20. The power generated by the integrated drive generator of this embodiment may be carried by a plurality of power feeders to a load, such as a power bus, within the body 12 of the aircraft 10. The power feeders may extend, for example, from the engine nacelle 20, through the pylori 18 and the wing 14 that carries the engine 16 and into the body 12 of the aircraft 10. An aircraft 10 may be at some risk of exposure to an electromagnetic pulse, particularly while flying. As those portions of the aircraft 10 that are external to the body 12 of the aircraft, such as the wings 14, the pylons 18 and the engine nacelles 20, may not provide as much protection from electromagnetic pulses as provided by the body of the aircraft in order to protect the people onboard the aircraft, the portion of the power feeders that extend beyond the body of the aircraft, such as the portion of the power feeders that extends from the body of the aircraft to the integrated drive generator within an engine nacelle may be at risk to exposure to electromagnetic pulses. As such, the power feeders may include electromagnetic pulse shields and the method and apparatus of an example embodiment of the present disclosure may provide an electromagnetic pulse shield ground path to protect the power feeders from the deleterious effects of an electromagnetic pulse.

Referring now to FIG. 2, an integrated drive generator 22 and a shielded power feeder assembly 24 of one embodiment of the present disclosure are depicted. As noted above, the integrated drive generator 22 may, in one embodiment, be positioned within the engine nacelle 20 and may generate power to be provided to various loads onboard the aircraft 10. The integrated drive generator 22 of the illustrated embodiment includes a housing 23 and one or more terminal blocks 26. Although the housing 23 of the integrated drive generator 22 may be formed of various materials, the housing of the integrated drive generator of one embodiment may be formed of magnesium.

In order to carry the power produced by the integrated drive generator 22 to one or more loads, such as one or more loads within the body 12 of the aircraft 10, a plurality of conductors 28 may be provided. The conductors 28 may include, for example, a central conductor and an insulative sheath surrounding the central conductor. In one embodiment, the plurality of conductors 28 include a neutral conductor and at least one power feeder conductor. In an instance in which the integrated drive generator 22 generates three phase power, the plurality of conductors 28 may include three power feed conductors for carrying the power of a respective phase. Each conductor 28, including the neutral conductor and the at least one power feeder conductor, includes an electromagnetic pulse shield, at least on that portion of the conductor that extends external to the body 12 of the aircraft 10. Although the electromagnetic pulse shield may be constructed in various manners in order to reduce the exposure of the power carried by respective conductor 28, the electromagnetic pulse shield of one embodiment may be a braided sheath formed of copper coated with tin.

As shown in FIG. 2, the plurality of conductors 28 may be electrically connected to the source of the power, such as the integrated drive generator 22. In the illustrated embodiment, the plurality of conductors 28 may be electrically connected to respective terminal blocks 26, such as by means of crimp terminals 29 that are electrically connected to both the ends of the conductors and to the terminal blocks also shown in FIG. 3. The plurality of conductors 28 may then extend to the load, such as a power bus. Relative to the example of FIG. 1, the plurality of conductors 28 may extend from the engine nacelle 20, through a pylori 18 and a wing 14 into the body 12 of the aircraft 10. As shown in FIGS. 2 and 3, a shielded power feeder assembly 24 may be provided in accordance with an example embodiment in order to provide an electromagnetic pulse shield ground path, thereby protecting the conductors 28 from electromagnetic pulses. In the embodiment of FIG. 1 in which the source of power is an integrated drive generator 22, the shielded power feeder assembly 24 may also be positioned external to the body 12 of the aircraft and, in one embodiment, may be positioned proximate the integrated drive generator, such as within a predefined distance, such as within 6 inches, of the integrated drive generator.

The shielded power feeder assembly 24 may include a fanning bar ground block 30. The fanning bar ground block 30 separates and positions the plurality of conductors 28. As shown, for example, in FIG. 4, the fanning bar ground block 30 may include a housing 32 and a body member formed, in one embodiment, of an insert 34 disposed within the housing. The housing 32 may be formed of an electrically conductive material, such as a conductively coated aluminum or steel alloy. In the illustrated embodiment, the housing 32 may be formed of a plurality of separable portions to facilitate the insertion and removal of the insert 34. For example, the housing 32 may be formed of two portions that may be secured to one another, such as by means of bolts or other types of connectors.

As shown in FIGS. 4 and 5, the insert 34 defines a plurality of openings 36 that are configured to receive respective conductors 28. For example, the insert 34 may define an opening, such as a smaller opening, through which the neutral conductor will extend and one or more openings, such as larger openings, through which respective power feeder conductors will extend. The insert 34 may be larger than the window defined by the housing 32 as illustrated in FIG. 5 in which the dashed line indicates the degree to which the housing ovelaps with the insert. Thus, the portions of the housing 32 may be separated and the insert 34 may be positioned therewithin with only that portion of the insert that is within the dashed lines being visible once the housing has been reassembled. After reassembling the housing 32, the insert 34 may be secured therewithin. The insert 34 may be formed of various materials, but is formed of a high temperature rubber in one embodiment.

As shown in FIGS. 6 and 7, the fanning bar ground block 30 may also include a plurality of barrels 38 which extend outwardly from the housing 32 and the insert 34. The plurality of barrels 38 are associated with respective openings 36 defined by the insert 34 and, in one embodiment, are aligned with the respective openings such that the conductors 28 also extend through the respective barrels. The plurality of barrels 38 may be formed of an electrically conductive material, such as a conductively coated aluminum or steel alloy. Additionally, the plurality of barrels 38 are positioned relative to the housing 32 so as to be in electrical contact with the housing. For example, the plurality of barrels 38 may be integral with the housing 32. Alternatively, the plurality of barrels 38 may include one or more flanges that protrude radially from the outwardly extending portion of the barrels such that the one or more flanges may be attached to the housing 32, such as by means of rivets, bolts, screws or other connectors that extend through the flanges. In an embodiment in which the housing 32 is formed of a plurality of portions, the plurality of barrels 38 may each also be formed of a plurality of portions, such as two portions as shown in FIGS. 6 and 7, in order to permit the plurality of barrels to separate in the same fashion as the housing.

As described below, each barrel 38 may be positioned in electrical contact with the shield of a respective conductor 28. In one embodiment, for example, the barrel 38 may be inserted between the shield and the conductor 28 that extends through the shield. In order to maintain a secure electrical contact between the plurality of barrels 38 and the shields of respective conductors 28, the shielded power feeder assembly 24 may also include a plurality of clamps 40, such as a plurality of band clamps. While described to be positioned between the shield and the conductor 28, the barrel 38 of an alternative embodiment may be positioned outside of the shield so as to extend circumferentially thereabout while maintaining electrical contact therewith. Each clamp 40 encircles a respective shielded conductor 28 and a respective barrel 38 so as to maintain the shield of the respective shielded conductor and the respective barrel in secure electrical contact. The clamp 40 may be formed of various materials, but, in one embodiment, is formed of aluminum with a nickel coating.

In order to also maintain the relative position of each barrel 38 with respect to the shield of the conductor 28 that extends through the respective barrel, the shielded power feeder assembly 24 may also include a friction material 42 carried by the barrels. In one embodiment, the inner surface of the barrels 38 that faces and makes contact with the conductors 28 may be coated with the friction material 42. The friction material 42 increases the coefficient of friction (relative to the coefficient of the barrels 38) with respect to the conductor 28 extending therethrough such that the increased levels of force are required to dislodge the barrels relative to the conductors extending therethrough.

As described above, the barrels 38 are positioned in electrical contact with the electromagnetic pulse shields of the respective conductors 28. The barrels 38, in turn, are in electrical contact with the housing 32 of the fanning bar ground block 30. In order to ground the shields of the conductors 28, the shielded power feeder assembly 24 also includes a ground path 44 extending from the fanning bar ground block 30 to ground. As a result of the electrical connection of each of the barrels 38 to the housing 32 of the fanning bar ground block 30, a single ground path 44 may be defined from the fanning bar ground block to ground, thereby making the installation of the shielded power feeder assembly 24 more efficient than techniques that require separate grounding of the shield of each conductor. The ground path 44 is formed of an electrically conductive material and may be constructed in various manners. In one embodiment, however, the ground path 44 is a flat braid formed of copper and coated with tin.

The ground path 44 may extend from the fanning bar ground block 30 to ground. In one embodiment, the ground is located within a predefined distance, such as within 6 inches, of the fanning bar ground block 30 such that the ground path 44 is relative short. In the embodiment illustrated in FIG. 2, for example, the housing 23 of the integrated drive generator 22 may serve as ground such that the ground path 44 is connected to the housing of the integrated drive generator. By electrically connecting the electromagnetic pulse shields to ground, such as in the manner described above, the conductors 28 extending through the shields may be protected from the deleterious effects of an electromagnetic pulse.

Referring now to FIG. 8, the operations performed in order to provide an electromagnetic pulse shield ground path are illustrated. As shown in block 50, a plurality of conductors 28 are extended through respective openings 36 defined by a body member, such as an insert 34, of a fanning bar ground block 30. By extending through the openings 36, the plurality of conductors also extend through respective barrels 38, which are associated with and may be aligned with corresponding openings. In one embodiment, the plurality of conductors 28 include a neutral conductor and at least one power feeder conductor and, in the illustrated embodiment, the plurality of conductors include a neutral conductor and a plurality of power feed conductors, such as three power feed conductors—one for each of the three phases of power. Although each conductor 28 may include an electromagnetic pulse shield, the electromagnetic shield may have been removed from end portions of the conductors such that the electromagnetic pulse shields terminates proximate the clamp 40 and does not extend to the fanning bar ground block 30 and to the terminal blocks 26.

In one embodiment, the extension of the plurality of conductors 28 through respective openings 36 defined by the body member, such as the insert 34, of a fanning bar ground block 30 includes extending the plurality of conductors from an integrated drive generator 22 positioned outside of a body of a vehicle, such as from an integrated drive generator 22 of an engine nacelle 20, to an interior of the body of the vehicle, such as the interior of the body 12 of an aircraft 10. In this embodiment, the fanning bar ground block 30 and the ground path 44 may also be positioned outside of the body of the vehicle. For example, the fanning bar ground block 30 may be positioned proximate the integrated drive generator 22, such as within a predefined distance, e.g., 6 inches, of the integrated drive generator.

As shown in block 52, electrical contact may be established between the plurality of barrels 38 of the fanning bar ground block 30 that are associated with, such as by being aligned with, respective openings 36 defined by the body member, such as the insert 34, and the shields of the conductors 28 that extend through the respective openings. In one embodiment shown in FIG. 9, the conductors 28 extend through the barrels 38 and the barrels may be inserted between the insulative sheath that surrounds the central conductor and the shields of the conductors such that the outer surface of the barrels and the inner surface of the shields are in direct electrical contact. The shields of the respective conductors 28 may be secured to the barrels 28 that are positioned in electrical contact with respective shields. In this regard, to maintain secure electrical contact between the barrels 38 and the shields of the conductors 28, a clamp 40 may extend about that portion of the shield of the conductor that surrounds the barrel. As described above, the shield may be removed from end portions of the conductors 28 and, in one embodiment, the endmost portion of the shield that remains following the removal of the shield from end portions of the conductors, may be folded back upon itself. As shown in FIG. 9, the barrel 38 may therefore be inserted between the conductor 28 and the endmost portion of the shield that has been folded back upon itself. In this embodiment, the clamp 40 may also surround the endmost portion of the shield that has been folded back upon itself as well as the underlying barrel 38.

Referring now to block 54 of FIG. 8, the shields of the conductors 28 may be grounded via a ground path 44 extending from the fanning bar ground block 30. Although the ground path 44 may extend to various grounds, the ground path of the illustrated embodiment extends to and is electrically connected to the housing 23 of the integrated drive generator 22, which serves as a system ground. The grounding of the ground path 44 effectively grounds the shields of the conductors 28. In this regard, the shields of the conductors 28 are electrically connected to the barrels 38 which, in turn, are electrically connected to the housing 32 of the fanning bar ground block 30 and then, via the ground path 44, to ground.

Many modifications and other embodiments of the disclosure set forth herein will come to mind to one skilled in the art to which these embodiments pertain having the benefit of the teachings presented in the foregoing descriptions and the associated drawings. Therefore, it is to be understood that the disclosure is not to be limited to the specific embodiments disclosed and that modifications and other embodiments are intended to be included within the scope of the appended claims. Although specific terms are employed herein, they are used in a generic and descriptive sense only and not for purposes of limitation.

What is claimed is:

1. An apparatus for providing an electromagnetic pulse shield ground path, the apparatus comprising:

a fanning bar ground block comprising a body member defining a plurality of openings for receiving respective conductors, wherein the plurality of openings include a neutral opening and at least one power feeder opening, wherein the neutral opening is configured to receive a shielded neutral conductor and each power feeder opening is configured to receive a respective shielded power feeder conductor, and wherein the fanning bar ground block further comprises a plurality of barrels associated with respective openings defined by the body member and configured to be positioned in electrical contact with a shield of the conductor extending through the respective opening;

a plurality of clamps, wherein each clamp is associated with a respective one of the conductors and is configured to secure the shield of the respective conductor to the barrel that is positioned in electrical contact with the shield; and a ground path extending from the fanning bar ground block.

2. An apparatus according to claim 1 wherein the body member of the fanning bar ground block comprises a housing formed of a conductive material and an insert disposed within the housing, wherein the insert is formed of an insulative material and defines the plurality of openings, and wherein the plurality of barrels and the ground path are in electrical contact with the housing.

3. An apparatus according to claim 2 wherein the plurality of barrels extend outwardly from the housing.

4. An apparatus according to claim 1 wherein the plurality of barrels are formed of a conductive material and are aligned with respective openings defined by the body member.

5. An apparatus according to claim 1 further comprising a friction material carried by the plurality of barrels.

6. A shielded power feeder assembly comprising:

a plurality of conductors comprising a neutral conductor and at least one power feeder conductor, each conductor comprising an electromagnetic pulse shield;

a fanning bar ground block comprising a body member defining a plurality of openings for receiving respective neutral and power feeder conductors, wherein the fanning bar ground block further comprises a plurality of barrels associated with respective openings defined by the body member and configured to be positioned in electrical contact with the shield of the conductor extending through the respective opening; and a ground path extending from the fanning bar ground block.

7. A shielded power feeder assembly according to claim 6 wherein the plurality of conductors are configured to extend from an integrated drive generator positioned outside of a body of a vehicle to an interior of the body of the vehicle.

8. A shielded power feeder assembly according to claim 7 wherein the fanning bar ground block and the ground path are also configured to be positioned outside of the body of the vehicle.

9. A shielded power feeder assembly according to claim 6 further comprising a plurality of clamps, wherein each clamp is associated with a respective one of the conductors and is configured to secure the shield of the respective conductor to the barrel that is positioned in electrical contact with the shield.

10. A shielded power feeder assembly according to claim 6 wherein the body member of the fanning bar ground block comprises a housing formed of a conductive material and an insert disposed within the housing, wherein the insert is formed of an insulative material and defines the plurality of openings, and wherein the plurality of barrels and the ground path are in electrical contact with the housing.

11. A shielded power feeder assembly according to claim 10 wherein the plurality of barrels extend outwardly from the housing.

12. A shielded power feeder assembly according to claim 6 wherein the plurality of barrels are formed of a conductive material and are aligned with respective openings defined by the body member.

13. A shielded power feeder assembly according to claim 6 further comprising a friction material carried by the plurality of barrels.

14. A method for providing an electromagnetic pulse shield ground path, the method comprising:

extending a plurality of conductors through respective openings defined by a body member of a fanning bar ground block, wherein the plurality of conductors comprise a neutral conductor and at least one power feeder conductor, each conductor comprising an electromagnetic pulse shield;

establishing electrical contact between a plurality of barrels of the fanning bar ground block that are associated with respective openings defined by the body member and the shields of the conductors extending through the respective openings; and grounding the shields of the conductors via a ground path extending from the fanning bar ground block.

15. A method according to claim 14 wherein extending the plurality of conductors through respective openings comprises extending the plurality of conductors from an integrated drive generator positioned outside of a body of a vehicle to an interior of the body of the vehicle.

16. A method according to claim 15 wherein extending the plurality of conductors from the integrated drive generator to the interior of the body of the vehicle comprises extending the plurality of conductors from the integrated drive generator of an engine nacelle to the interior of an aircraft.

17. A method according to claim 15 further comprising positioning the fanning bar ground block and the ground path outside of the body of the vehicle.

18. A method according to claim 14 further comprising securing the shields of the respective conductors to the barrels that are positioned in electrical contact with respective shields.

19. A method according to claim 14 wherein the body member of the fanning bar ground block comprises a housing formed of a conductive material and an insert disposed within the housing, wherein the insert is formed of an insulative material and defines the plurality of openings, and wherein the method further comprises establishing electrical contact between the housing and the plurality of barrels and the ground path.

20. A method according to claim 14 wherein the plurality of barrels are formed of a conductive material, and wherein the method comprises aligning the barrels with respective openings defined by the body member.

* * * * *